United States Patent [19]

Simpson

[11] Patent Number: 5,056,151

[45] Date of Patent: Oct. 8, 1991

[54] ELECTRICAL COMPONENT CONNECTION AND COMBINATIONS OF ELECTRICAL COMPONENTS

[75] Inventor: Robert G. Simpson, Dundas, Canada

[73] Assignee: Gennum Corporation, Burlington, Canada

[21] Appl. No.: 409,378

[22] Filed: Sep. 19, 1989

[51] Int. Cl.[5] ..... H04R 25/00

[52] U.S. Cl. ..... 381/69; 361/394

[58] Field of Search ..... 381/68, 68.2, 68.4, 381/69; 361/405, 393, 394; 174/52.1; 439/59, 71

[56] References Cited

U.S. PATENT DOCUMENTS

| | | | |
|---|---|---|---|
| 2,947,914 | 8/1960 | Simons | 361/393 |
| 3,555,364 | 1/1971 | Matcorich | 361/394 |
| 4,688,864 | 8/1987 | Sorel | 361/394 |
| 4,783,815 | 11/1988 | Büttner | 381/68 |

FOREIGN PATENT DOCUMENTS

| | | | |
|---|---|---|---|
| 3616773 | 11/1987 | Fed. Rep. of Germany | 381/68 |

*Primary Examiner*—Forester W. Isen
*Assistant Examiner*—M. Nelson McGeary, III
*Attorney, Agent, or Firm*—Rogers, Bereskin & Parr

[57] ABSTRACT

An electrical component combination having a receiver and an amplifier. The receiver has three pins extending from its front surface. The amplifier has six pads on its rear surface. The pins are bonded to three of the pads providing electrical and mechanical connection between the receiver and amplifier. The other pads may provide frequency control, power control and gain trim. The combination is placed within a hearing aid housing. The housing may be an in the ear type. The combination provides electrical and mechanical access to the components. The components may be receivers, amplifiers, pre-amplifiers, filters, microphones or other such components.

22 Claims, 2 Drawing Sheets

ELECTRICAL COMPONENT CONNECTION AND COMBINATIONS OF ELECTRICAL COMPONENTS

FIELD OF THE INVENTION

This invention relates to connections between electrical components and combinations of electrical components.

BACKGROUND OF THE INVENTION

It has always been desirable to limit the amount of space taken up by electrical components. This allows for the creation of the smallest possible devices which employ those components. Where a device employs more than one electrical component it is also desirable to be able to pack those devices as closely as possible.

Typically, components are soldered to a printed circuit board and connections are provided by lines on the board. The board is then placed within a device housing.

Where it is desirable to minimize the volume of the device the printed circuit board is often dispensed with as it requires space. The components are then hardwired to one another. This is done especially where there is a relatively small number of components and connections within the device.

Both printed circuit board and hardwired connections require at least two solder joints for most electrical connections, one where each component is connected to the line or wire.

An example of such a demand for miniaturization is the hearing aid industry. The pressure for increasingly smaller volume hearing aids, or devices, has grown as hearing aids have shrunk from over the ear devices to in the ear devices, and more recently to in the canal devices. An in the canal device is concealed almost entirely within the ear canal. Only a small portion of the device is noticeable from outside the ear, and only on close inspection.

At least one manufacturer of components for such devices has responded by pairing components within a single component shell. This decreases the overall volume of the two components when compared to their volume as separate hardwired units.

Unfortunately, the placement of the components within a single shell does not allow for access to the components for repair, replacement or electrical adjustment. When one of the components is damaged the whole shell, including both components, is discarded.

In a hearing aid one of the components may be a receiver, otherwise known as a speaker, and the other an amplifier. The receiver is prone to break down much more readily than is the amplifier. This is due to the build-up of bodily secretions within the output port of the receiver. Amplifiers often cost a few dollars or more and it becomes expensive to discard both components when only one is faulty.

Additionally, placing both components in a single shell restricts electrical access to the components. At least one manufacturer uses a similar shell for its receiver/amplifier combination as for its receiver by itself. A receiver only shell typically has two or three supply or signal inputs. This is suitable for a receiver, however for maximum flexibility an amplifier may have other inputs. In addition to the above, it may be desirable to have frequency control, power control and gain trim inputs. These require direct connections for each input.

As well, a two component shell does not allow for replacement of one of the components with a component having different characteristics or updated features. Again, both components must be replaced.

SUMMARY OF THE INVENTION

In a first aspect the invention provides An electrical component combination, comprising:

i. a first electrical component, including,
   (a) a first component body;
   (b) first and second retaining and electrical connection members extending from the first component body for providing mechanical and electrical connection thereto; and ii. a second electrical component, including,
   (a) a second component body;
   (b) first and second mechanical and electrical connection pads on the second component body for providing mechanical and electrical connection thereto;

wherein, the members are bonded to their respective pads and the components are mechanically held in close proximity to one another by such bond.

In a second aspect the invention provides a hearing aid, comprising:

i. a hearing aid housing;

ii. a first electrical component, including,
   (a) a first component body;
   (b) first and second retaining and electrical connection members extending from the first component body for providing mechanical and electrical connection thereto; and iii. a second electrical component, including,
   (a) a second component body;
   (b) first and second mechanical and electrical connection pads on the second component body for providing mechanical and electrical connection thereto;

wherein, the members are bonded to their respective pads and the components are mechanically held in close proximity to one another by such bond, and the components lie within the housing.

BRIEF DESCRIPTION OF THE DRAWINGS

For a better understanding of the present invention, and to show more clearly how it may be carried into effect, reference will now be made, by way of example to the accompanying drawings, which show a preferred embodiment of the present invention, and in which.

DETAILED DESCRIPTION OF THE PREFERRED EMBODIMENT

Figure 1:
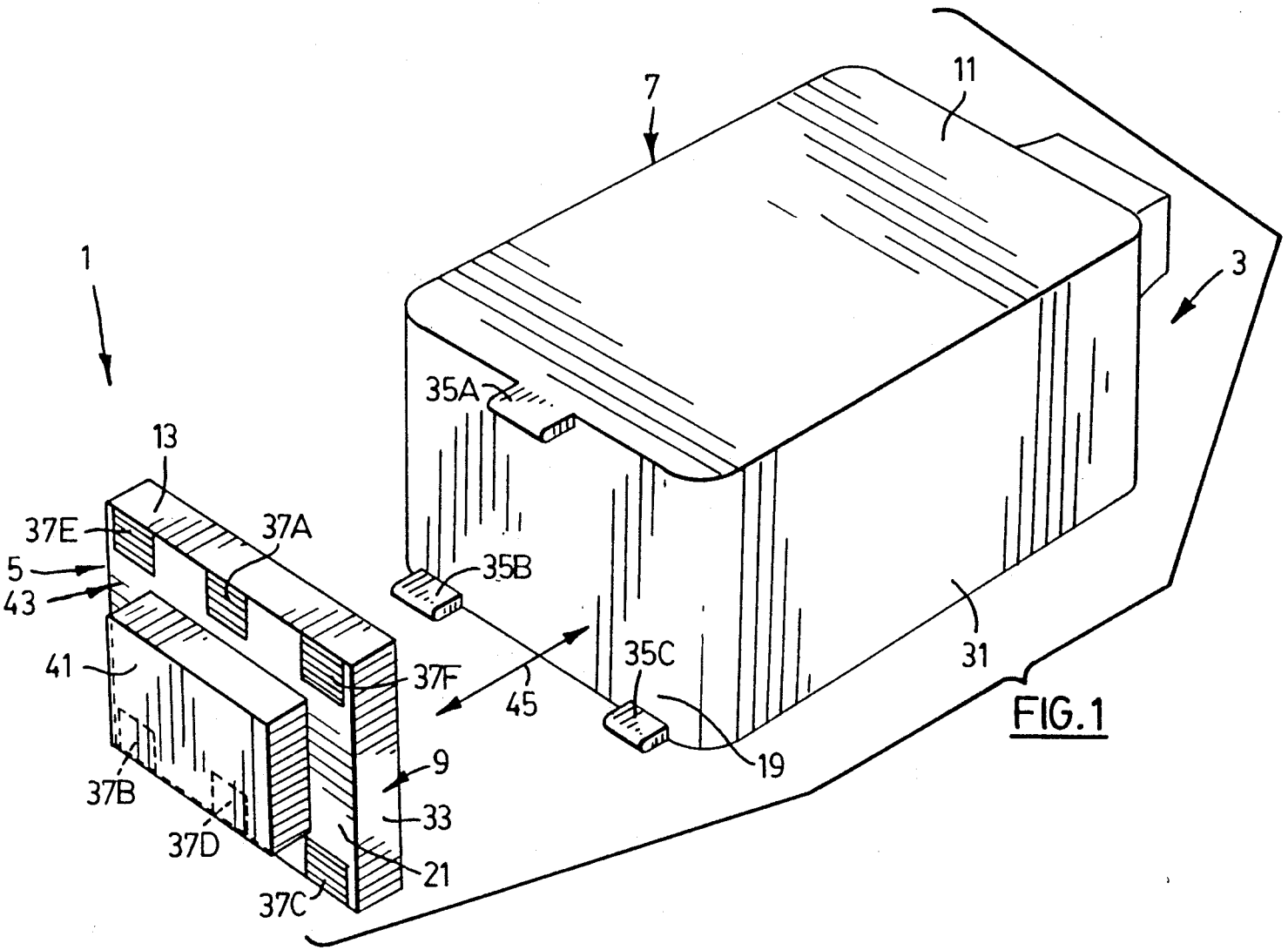
FIG. 1 is an exploded perspective view from above, in front and to one side view of a component combination according to the preferred embodiment of the present invention.
Figure 4:
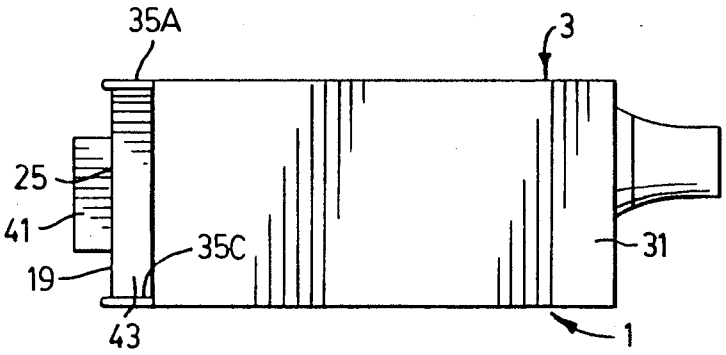
FIG. 4 is a side elevation view of the combination of FIG. 1.
Figure 2:
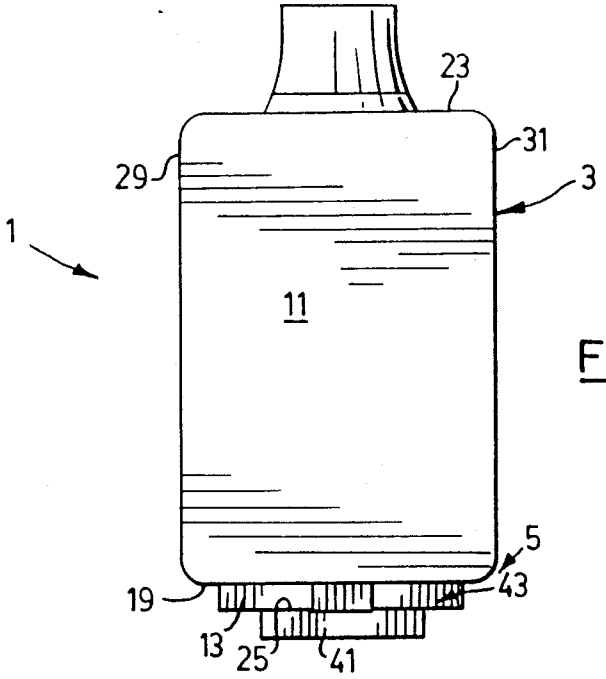
FIG. 2 is a plan view of the combination of FIG. 1.
Figure 3:
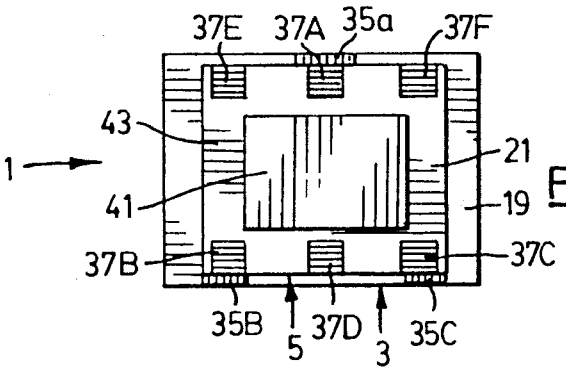
FIG. 3 is a front elevation view of the combination of FIG. 1.

Referring to FIGS. 1, 2, 3 and 4, a component combination 1 has a first electrical component 3 and a second electrical component 5. The components 3,5 each have a body 7,9. The bodies 7,9 each have top 11,13, bottom 15,17, front 19,21, rear 23,25, left 27,29 and right 31,33 surfaces. With reference to FIG. 1, the forward direction is predominantly out of the page, while the rearward direction is predominantly into the page. The left and right directions are predominantly to the left and right of the page when viewing the page. The top and bottom directions are toward the top and bottom of the page.

Component 3 has input signal and retaining members 35. The members 35 extend in front of the front surface 19. Component 5 has electrical pads 37 on its body 9.

The members 35 extend at least as far beyond the front surface 19 as the pads are from the rear surface 25. The members 35 hold the components 3,5 in close proximity to one another.

In the preferred embodiment, the first component 3 is a receiver 3. The members 35 include first, second and third pins 35A,35B,35C. The first pin 35A extends from the front surface 19 adjacent the top surface 11. The second and third pins 35B,35C extend from the front surface 11 adjacent the bottom surface 17.

Typically, two of the pins, for example 35A,35B are connected to a coil, not shown, which drives a loudspeaker, not shown, within the receiver 3. These receivers 3 are 2-terminal receivers 3. Some receivers 3 provide connections for all three pins 35A,35B,35C to the coil. These are 3-terminal receivers 3. With a 2-terminal receiver 3, the third pin, for example 35C, provides only mechanical connection to the receiver 3. It is possible to produce many of the advantages of the invention using a 2-terminal receiver 3 and only pins 35A and 35B, however it is preferable to continue to use pin 35C for additional mechanical strength.

In a 2-terminal receiver 3 the pins 35A,35B will typically provide connection for two signals, while in a 3-terminal receiver 3 the pins 35A,35B,35C will typically provide connection for two signals and a supply. Although there are other possible configurations of supply and signal lines to the receiver 3 there must be at least one signal and either another signal or supply.

Again in the preferred embodiment, component 5 is an amplifier 5. The amplifier 5 has an amplifier chip 41 mounted on a chip carrier 43. The chip 41 and carrier 43 make up the body 9. The chip 41 projects from the front surface 21. The pads 37 are on the front surface 21 adjacent the top and bottom surfaces 13,17. The pads 37 are connected directly, or indirectly, through the carrier 43 to the chip 41.

As is known in the art, discrete components, not shown, forming part of an electrical circuit, not shown, including the combination 1 may lie on, or within, the carrier 43 adjacent, or beneath, the chip 41. Such discrete components may, for example, include resistors or capacitors.

Other external integrated circuits or discrete components, not shown, may be connected to the carrier 43 at the pads 37. This allows for alteration of the characteristics of the electrical circuit including the combination 1 without changing the amplifier 5 or receiver 3. Such alteration may be performed at the time the circuit is assembled or after.

The pins 35 extend substantially perpendicular to the front surface 19. The pins 35 are slightly longer than the carrier 43 is deep. In this instance, depth is measured from the front to rear surfaces 21,25.

To form the combination, the rear surface 25 is brought into close proximity to the front surface 19, as shown by the arrows 45 in FIG. 1. The proximity of the front and rear surfaces 19, 25 will depend primarily on the heat generated therebetween during operation of the components 3,5. The hotter the components 3,5 become the further apart the surfaces 19,25 should be. Typically, in hearing aid applications, the front and rear surfaces 19,25 may be flush with one another as the operating temperatures of the components 3,5 are relatively low.

The pins 35 are spaced so that there tips will be in close proximity to the appropriate pads 37 and can be bonded thereto to provide an electrical connection. Prior to bonding, the pins 35 must be sufficiently proximate to the pads 37 to allow bonding to occur. The bond may be formed by soldering or the like. As the pins 35 are bonded directly to the pads 37 only one joint is required per connection. Separate wires and lines are dispensed with. This decreases processing steps, the amount of materials and the number of points where faults may occur.

It will be evident to those skilled in the art that the pins 35 may extend from surfaces other than the front surface 19 of the receiver 3. For instance, the pins 35 could extend outwardly from one or more of the top, bottom, rear, left or right surfaces 11, 15, 23, 27, 31 bend forwardly and extend across the thickness of the carrier 43. Alternatively, the pins 35 could be replaced by pads, not shown, on the receiver 3 and pins, not shown, extending from the amplifier 5. Furthermore, the pins 35 can be extended beyond the surface of the amplifier 5 and bent over the pads 37. This can provide additional mechanical strength to the combination 1. It will however add material and an extra step to the manufacturing process. Where the additional mechanical strength is not required, such as in most hearing aid applications, the pins 35 need not be bent over.

The configuration described in the preferred embodiment is preferred as it: (a) requires a minimum of manufacturing steps; (b) consumes a minimum volume; (c) has a relatively high mechanical strength; (d) allows for electrical access to the connections and (e) allows for access to the connections for repair or replacement.

The combination 1 is placed with a hearing aid housing, not shown, formed from plastic. As the combination 1 is compact the housing may be an in the canal type. Such a housing is barely visible when in place, encouraging the use of hearing aids by people that would not otherwise use one.

It will be obvious to those skilled in the art that the combination 1 described herein may be used with electrical components, not shown, other than receivers and amplifiers. For example, pre-amps, filters and microphones could be used. Typically, a microphone would be a first component 3, while a pre-amp or filter would be part of a second component 5.

It will be evident to those skilled in the art that there are other embodiments of the present invention which fall within it spirit and scope as defined by the following claims.

I claim:

1. An electrical component combination, comprising:

i. a first electrical component, including, (a) a first component body having a front face, said first component body not being a circuit board;

(b) first and second rigid retaining and electrical connection members extending from the first component body from positions adjacent said front face for providing mechanical and electrical connection thereto; and ii. a second electrical component, including,
(a) a second component body having a front face, a rear face, and a sidewall spacing apart said front and rear faces, said second component body not being a circuit board;
(b) first and second mechanical and electrical connection pads on the second component body adjacent said front face thereof for providing mechanical and electrical connection thereto;
iii. said component bodies being located adjacent each other with the entire rear face of said second body lying against said front face of said first body and said members extending over said sidewall, in close proximity to said sidewall, to positions adjacent said pads, said members being bonded to their respective pads so that said components are mechanically held in close proximity to one another by said members;
iv. one of said components comprising a transducer for a hearing aid.

2. An electrical component combination according to claim 1, further comprising, a third rigid retaining member extending from the first component body from a position adjacent said front face thereof for providing mechanical connection thereto, and a third mechanical connection pad on the second component body adjacent said front face of said second component body for providing mechanical connection thereto, said third retaining member extending over said sidewall, in close proximity thereto, to a position adjacent said third pad and being bonded to said third pad.

3. An electrical component combination according to claim 2, wherein, the third retaining member is a third retaining and electrical connection member for providing electrical and mechanical connection to the first component body, and the third mechanical connection pad is a mechanical and electrical connection pad for providing mechanical and electrical connection to the second component body.

4. An electrical component combination according to claim 1, 2, or 3, wherein, at least one of the members and corresponding pads provide electrical connection for a signal.

5. An electrical component combination according to claim 1, 2 or 3, further comprising a fourth pad on the first component body connected to an input of the first component selected from the group consisting of frequency control, power control and gain trim.

6. An electrical component combination according to claim 1, 2 or 3 and including a hearing aid housing, said components lying within said housing, one of said components being a hearing aid amplifier and the other being a hearing aid receiver.

7. An electrical component combination according to claim 2, wherein said first component is a hearing aid receiver and said second component is a hearing aid amplifier.

8. An electrical component combination according to claim 2, wherein the members are pins extending substantially perpendicular to said front surface of the first component body.

9. An electrical component combination according to claim 8, wherein the pins extend beyond said front face of the second component body and are bent toward the pads.

10. An electrical component combination according to claim 8, wherein the pins have tips which are in close proximity to their respective pads.

11. An electrical component combination according to claim 10, wherein the tips of the pins are soldered to their respective pads.

12. An electrical component combination according to claim 3, wherein, the first component is selected from the group consisting of a receiver and microphone, and the second component is selected from the group consisting of an amplifier, pre-amp and filter.

13. An electrical component combination according to claim 1 or 3, wherein the first component is a receiver and the second component is an amplifier.

14. An electrical component combination according to claim 3, wherein, one of the components is selected from the group consisting of an amplifier, pre-amp and filter, and wherein the other component is selected from the group consisting of a receiver and microphone.

15. An electrical component combination according to claim 3, wherein the bodies include, top and bottom surfaces, and wherein at least one of the first, second and third pads is adjacent the top surface and at least one of the first, second and third pads is adjacent the bottom surface.

16. An electrical component combination according to claim 2, wherein the first component is a receiver and the second component is an amplifier.

17. An electrical component combination according to claim 16, wherein, one of the retaining and electrical connection members and corresponding mechanical and electrical connection pads provide electrical connection for a signal.

18. An electrical component combination according to claim 17, wherein the amplifier includes an amplifier chip having electrical inputs, the chip is carried by a chip carrier and the pads are on the chip carrier and connected to the electrical inputs.

19. An electrical component combination according to claim 18, further comprising a fourth pad on the amplifier connected to a frequency control input of the amplifier, a fifth pad on the amplifier connected to a power control input to the amplifier and a sixth pad on the amplifier connected to a gain trim input to the amplifier.

20. An electrical component combination according to claim 19, wherein the fourth, fifth and sixth pads are on the front surface of the amplifier.

21. An electrical component combination according to claim 19, wherein the bodies include, top and bottom surfaces, and three of the pads are adjacent the top surface and the other three pads are adjacent the bottom surface.

22. An electrical component combination according to claim 18, further comprising a fourth pad on the amplifier connected to an input of the amplifier selected from the group consisting of frequency control, power control and gain trim.

* * * * *